US006675991B2

(12) United States Patent
Johnson et al.

(10) Patent No.: US 6,675,991 B2
(45) Date of Patent: Jan. 13, 2004

(54) UNI-DRUM RAM PLATE FOR HIGH VISCOSITY MATERIALS

(75) Inventors: Todd L. Johnson, Minneapolis, MN (US); Troy A. Eidenschink, deceased, late of South St. Paul, MN (US), by Jennifer L. Eidenschink, legal representative

(73) Assignee: Graco Minnesota Inc., Minneapolis, MN (US)

( * ) Notice: Subject to any disclaimer, the term of this patent is extended or adjusted under 35 U.S.C. 154(b) by 187 days.

(21) Appl. No.: 10/166,326

(22) Filed: Aug. 20, 2001

(65) Prior Publication Data

US 2003/0071082 A1 Apr. 17, 2003

(51) Int. Cl.[7] ..... B67D 5/42
(52) U.S. Cl. ..... 222/387; 222/405; 222/481.5
(58) Field of Search ..... 222/152, 386, 222/387, 405, 481.5; 220/227; 137/517, 519, 519.5, 520

(56) References Cited

U.S. PATENT DOCUMENTS

| | | | | | |
|---|---|---|---|---|---|
| 4,080,005 | A | | 3/1978 | Engle | 303/22 |
| 4,209,105 | A | * | 6/1980 | Dominique | 220/578 |
| 4,630,760 | A | | 12/1986 | Wold | 222/387 |
| 4,632,281 | A | | 12/1986 | Wold | 222/389 |
| 4,776,638 | A | | 10/1988 | Hahn | 299/5 |
| 5,178,305 | A | * | 1/1993 | Keller | 222/386 |
| 5,265,653 | A | | 11/1993 | Herlth | 141/65 |
| 5,573,045 | A | | 11/1996 | Akazawa | 141/92 |
| 5,674,602 | A | | 10/1997 | Karabedian et al. | 428/304 |
| 5,766,470 | A | | 6/1998 | Burns | 210/406 |
| 5,871,120 | A | | 2/1999 | Romero et al. | 222/53 |
| 5,957,338 | A | * | 9/1999 | Lehmann | 222/184 |
| 6,112,758 | A | * | 9/2000 | Wooten | 137/71 |
| 6,230,941 | B1 | * | 5/2001 | Amberg | 222/235 |
| 6,290,105 | B1 | * | 9/2001 | Cosentino | 222/387 |

* cited by examiner

*Primary Examiner*—Gene Mancene
*Assistant Examiner*—Patrick Buechner
(74) *Attorney, Agent, or Firm*—Douglas B. Farrow

(57) ABSTRACT

A ram plate which allows easy lifting and dropping of the plate even when a complete seal has been made with high-viscosity liquids inside a barrel. The system contains two alternative methods of depressurizing the internal liquids in order to more efficiently avoid vacuum and suction effect when the user attempts to raise the plate. The bleed stick components of the plate are completely independent of vent ports components. Such bleed stick components are levers which, when depressed, will move a cover and expose the internal liquids to outside air pressure via air vents. The vent port components operate through both gravity and potential energy of an internal spring, which place a given amount of downward pressure on a pneumatic cylinder which may or may not be enough pressure to move the cylinder and expose a vent to the outside atmosphere pressure.

2 Claims, 2 Drawing Sheets

UNI-DRUM RAM PLATE FOR HIGH VISCOSITY MATERIALS

RELATED APPLICATIONS

BACKGROUND OF THE INVENTION

Existing ram plate designs for evacuating viscous materials from large (300 gallon) reusable containers require the user to exhaust when lowering and vent when raising from the same port. Higher viscosity materials in the range of 100,000 cps (centipoise) will not evacuate bleed materials from venting ports rapidly enough to allow proper airflow and lead to the creation of a vacuum inside the drum when raising existing ram plates.

The design herein allows increased airflow or venting to a 300-gallon drum when extracting the ram plate and facilitating the performance of drum change and maintenance. This design relocates the existing venting port from the pump-mounting collar and places it in a recessed pocket open to the bottom side of the ram plate.

Relocating the vent port should eliminate insufficient airflow caused by material restriction of the vent ports because the bleed and vent ports will be independent of each other. The user is able to bleed residual air from the drum manually with the use of a bleed stick as they lower the Ram plate on to the material surface. It is common practice for the user to keep the bleed port open to atmosphere until visual verification of material to the pump intake is made. They then replace the manual bleed stick and use the system to pump materials from the container.

When the user determines a need for the tote to be replaced they prepare the system per the operating instructions and begin to raise the ram plate from the tote. A pneumatic cylinder will drive the vent seal to an open position allowing airflow into the tote. Separation of the material bleed and air vent functions will minimize potential problems with material curing in the valving assembly, offer increased venting capacity, and facilitate easier cleaning and replacement.

SUMMARY OF THE INVENTION

Ram plates are used to pressurize liquids in their large barrels or containers, thus facilitating their pumping directly from said container to outside applications. The convenience cannot be overstated of taking such liquids directly from their transportation containers to direct application, especially when it is not uncommon for such barrels to contain 300 gallons of liquid. Currently, the industry uses ram plates with only one type of venting to allow air intake and exhaust to prevent suction and vacuum when the plate is moved vertically.

When dealing with high viscosity liquids, often a vent will be filled with liquid and such liquids fail to drip or fall from said vents. This obviously blocks the vent and prevents free flow of air, thus creating the suction or vacuum effect. The invention here contains a secondary method of manually exposing internal liquids to outside air pressure, thus depressurizing and removing the vacuum effect inside the barrel. Levers or bleed sticks are able to expose vents when manually depressed which allow free flow of air to the outside atmosphere in the event the vent ports are blocked.

Further, such invention contains a double-seal that runs the circumference of the plate that preserves internal pressure and allows up to ½ inch variance in the internal barrel circumference while maintaining effective seals.

Also, such invention has nodules that attach to a machine that raises and lowers the ram plate, such vertical movement being necessary to pressurizing the internal liquids.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
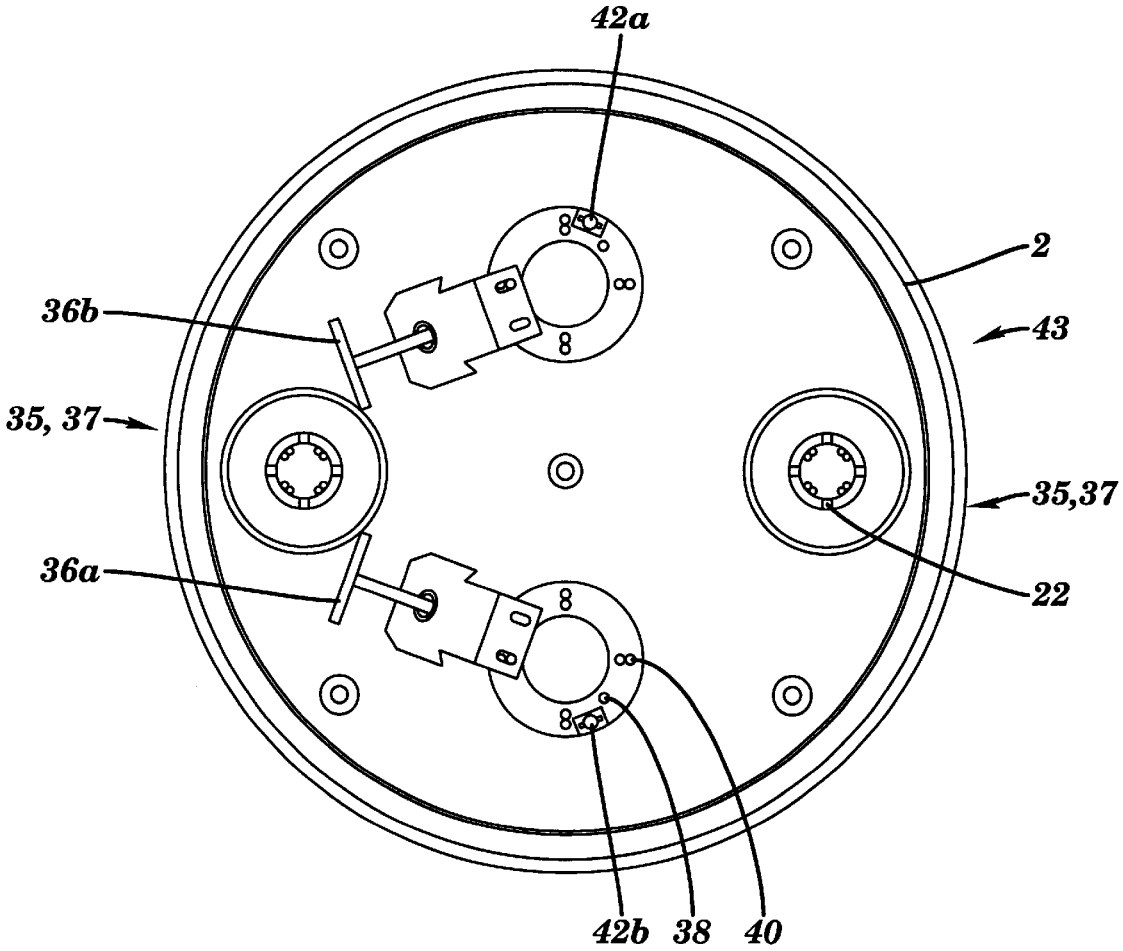
FIG. 1 is a view from above of the ram plate, showing various vents and bleed sticks.
Figure 2:
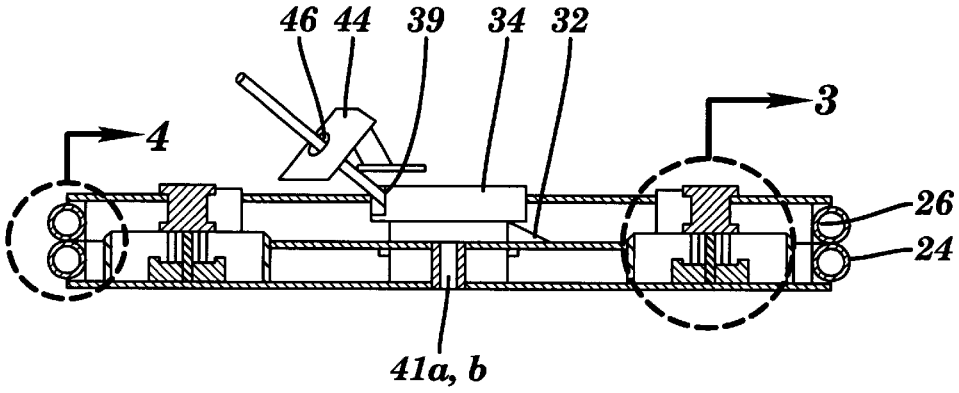
FIG. 2 is a cross-sectional view of the flat ram plate, showing the side seals, various vents and the bleed sticks.

The primary use of enclosed design is to transfer various liquids from a 300-gallon drum used in transportation of the liquids to external applicators. To this end, 42*a* and 42*b* of FIG. 1 refer to a pair of nodules wherein the user may threadedly articulate one or two hoses which will transport pressurized liquid directly from the drum to any number of applicator mechanisms. The nodules 42*a* and 42*b* are only opened when a hose is inserted, thus preventing inadvertent spilling of liquid. The liquid is pressurized due to the flat, heavy ram plate 43 exerting downward pressure on the surface of the internal liquid. When no air is present between the ram plate 43 and the surface of the liquid, and pressure is exerted upon the surface of the liquid, then pure liquid is forced through the cavity 41*a* or 41*b* to the corresponding ports 42*a* or 42*b* and onto the external applicator tubes.

Figure 3:
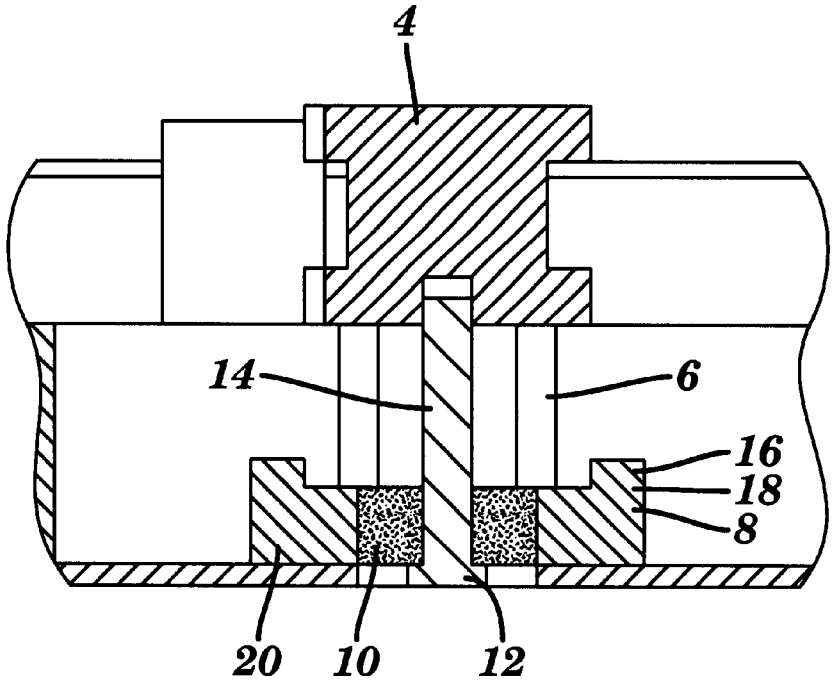
FIG. 3 is a detail of a vent contained in the ram plate.
Figure 4:
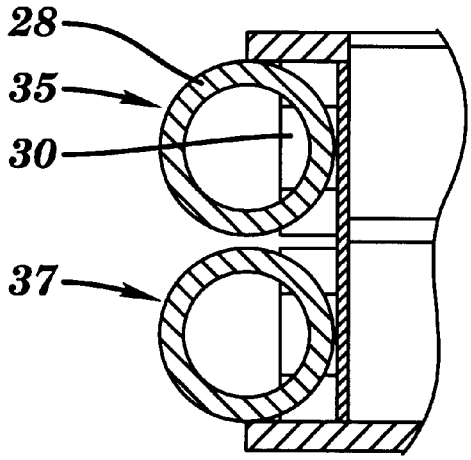
FIG. 4 is a detail of the airtight seal that runs along the circumference of the ram plate.

In the normal course of use the ram plate 43 must be lifted upwards and dropped downwards, often while no air exists between the plate and the liquid surface thus describing a liquid seal. In order to avoid vacuum and suction effects, air intake valves 22 are present on the plate on both nodules and in a circular grouping of four. As demonstrated by FIG. 3, the valves only allow air into the barrel when surface pressure of the liquid is diminished or the cylinder is not touching the surface of the liquid. Air will enter or exit via the intake valves 22 and travel downward via cavities 6 inside the plate. A pneumatic cylinder 12 is attached to a seal 10 which presses against another seal 20 that combine to block air inflow unless a spring 14 is able to exert downward pressure sufficient enough to break the surface tension of the internal liquid. In the resting position the pneumatic cylinder 12 extends below the bottom of the ram plate 43 and allows free airflow, but is pictured as if subject to pressure as spring 14 is depressed and pneumatic cylinder 12 is raised which closes the internal vents 6.

In the event the spring 14 pressure is unable to break the surface tension and press the cylinder 12 downward to allow air inflow, the user can resort to bleed sticks 36*a* or 36*b*. The user depresses either stick 36*a* or 36*b* that acts as a lever with fulcrum 39. Such stick 36 is attached to an internal plate 32, which rises and exposes the internal air of the cavity 41*a* or 41*b* to the outside atmosphere via the venting ports 38, 40 that are situated on the bleed stick nodules in a semi-circular grouping. The bleed sticks 36*a* or 36*b* should always be used when depressing the ram plate 43 in order to expel internal air to ensure pressurized and pure liquid output. The bleed sticks 36*a* or 36*b* may also be used to intake air when raising the ram plate 43 in the event the air intake valves 22 are unable to accomplish the speed and/or volume of desired intake, which is especially prevalent in high viscosity liquids. Such bleed sticks 36*a* or 36*b* have a shield 44 which protects the user in the event pressurized liquid mistakenly sprays from the venting ports 38 or 40 or articulation nodules 42*a* or 42*b*, which is attached only to the lever by way of a washer 46.

The seal 2 runs the circumference of the ram plate 43 and is comprised of two seals, the upper 35 and the lower 37. Both seals 35, 37 are made of polyurethane construction, which provides chemical compatibility and assured sealing because it will form and take shape of the adjacent sealing surface. Such seals 35, 37 are attached to the ram plate 43 by periodic screws 30 attached on the inside of the upper seal 35 and are located around the circumference of the plate. Further, the upper seal 35 contains a band which runs along the internal side of the upper seal 35 and articulates with the screw 30 holding the seal in place not just at the points where screws are present. Such barrel can have an internal circumference between the circumference of the ram plate 43 and the circumference of the seals 35, 37 and still have effective sealing. Such seals 35, 37 allow for a variance of approximately ½ inch in internal barrel circumference.

It is contemplated that various changes and modifications may be made to the unidrum ram plate for high viscosity materials without departing from the spirit and scope of the invention as defined by the following claims.

What is claimed is:

1. A ram plate that applies pressure to liquids contained in a barrel by force of gravity and means of allowing highly viscous liquids out of the barrel to be used in outside applicators comprising:

air intake vents allowing raising and lowering of said ram plate without a suction or vacuum effect;

pneumatic cylinders which allow depressurized air into the barrel when raising said ram plate, said cylinders, when in resting position vent to the inside of said barrel;

springs that press downward on said pneumatic cylinders that maintain venting when lowering said ram plate to the surface of the liquid to allow release of air inside said barrel until liquid pressure is greater than the downward force of said springs and said pneumatic cylinders rise and block venting; and bleed sticks which allow internal liquid and air to be exposed to outside atmosphere in order to depressurize or pressurize the barrel, said bleed sticks operating by depression of a lever to expose vents in said ram plate to the atmosphere.

2. The ram plate of claim 1 further comprising flexible seals running the circumference of said plate, which allow for approximately ½ inch variance in internal circumferences of barrels while maintaining effective seals.

* * * * *